US007995959B2

(12) United States Patent
Nakamura et al.

(10) Patent No.: US 7,995,959 B2
(45) Date of Patent: Aug. 9, 2011

(54) GLOSS IMPARTING METHOD, IMAGE FORMING METHOD, FIXING APPARATUS AND IMAGE FORMING APPARATUS

(75) Inventors: Satoshi Nakamura, Kanagawa (JP); Yutaka Nogami, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 323 days.

(21) Appl. No.: 12/404,728

(22) Filed: Mar. 16, 2009

(65) Prior Publication Data

US 2009/0245903 A1 Oct. 1, 2009

(30) Foreign Application Priority Data

Mar. 25, 2008 (JP) ..... 2008-078754

(51) Int. Cl.
*G03G 15/20* (2006.01)
*G03G 15/00* (2006.01)
*G03G 13/20* (2006.01)

(52) U.S. Cl. ... 399/341; 399/342; 399/407; 430/124.13; 430/124.2

(58) Field of Classification Search ..... 399/341, 399/342, 407; 430/124.13–124.2
See application file for complete search history.

(56) References Cited

U.S. PATENT DOCUMENTS

| | | | | |
|---|---|---|---|---|
| 6,920,304 | B2 * | 7/2005 | Kanesawa et al. | 399/328 |
| 2006/0127143 | A1 * | 6/2006 | Tamura et al. | 399/329 |
| 2009/0003904 | A1 * | 1/2009 | Yasutomi et al. | 399/341 |

FOREIGN PATENT DOCUMENTS

| | | |
|---|---|---|
| JP | 2001-042692 | 2/2001 |
| JP | 2002-244346 | 8/2002 |
| JP | 2003-280452 | 10/2003 |
| JP | 2005-084109 | 3/2005 |

* cited by examiner

*Primary Examiner* — David M Gray
*Assistant Examiner* — Joseph S Wong
(74) *Attorney, Agent, or Firm* — Morgan, Lewis & Bockius LLP

(57) ABSTRACT

A gloss-imparting method that includes (a) applying heat and pressure to one side of a recording material having an image of toner formed on both sides, and fixing the image to the one side of the recording material; (b) cooling the one side of the recording material; (c) applying heat and pressure to the other side of the recording material, and fixing the image to the other side of the recording material; and (d) cooling the other side of the recording material, in the step (a), the fixing being performed such that a value of $\exp(-T \cdot \tan \delta_0)$ will be approximately 0.85 or less, where $\tan \delta_0$ is a loss tangent of the toner when measured by dynamic viscoelastic measurement at a frequency of approximately 1 rad/sec at approximately the same temperature as a fixing temperature of the step (a), and T is a fixing time in the step (a).

8 Claims, 4 Drawing Sheets

| | | TONER p(tanδ = 1.0) | TONER q(tanδ = 3.0) |
|---|---|---|---|
| FIXING TIME T [ sec ] | 0.08 | IMAGE SAMPLE A | IMAGE SAMPLE C |
| | 0.3 | IMAGE SAMPLE B | IMAGE SAMPLE D |

| | IMAGE SAMPLE A | IMAGE SAMPLE B | IMAGE SAMPLE C | IMAGE SAMPLE D |
|---|---|---|---|---|
| $\sigma = \exp(-T \cdot \tan\delta 0)$ | 0.92 | 0.74 | 0.79 | 0.41 |
| GLOSS DIFFERENCE[%] | 41 | 22.6 | 24.3 | 6.8 |

| | IMAGE SAMPLE E | IMAGE SAMPLE F | IMAGE SAMPLE G | IMAGE SAMPLE H |
|---|---|---|---|---|
| $\sigma = \exp(-T \cdot \tan\delta 0)$ | 0.84 | 0.66 | 0.41 | 0.22 |
| GLOSS DIFFERENCE[%] | 40 | 30 | 25 | 15 |

| | SUBJECT | | | | | | | | | | AVERAGE SCORE |
|---|---|---|---|---|---|---|---|---|---|---|---|
| | I | II | III | IV | V | VI | VII | VIII | IX | X | |
| EVALUATION SAMPLE X | 1 | 1 | 1 | 1 | 2 | 2 | 1 | 1 | 2 | 1 | 1.3 |
| EVALUATION SAMPLE Y | 2 | 2 | 2 | 2 | 3 | 2 | 2 | 2 | 2 | 2 | 2.1 |
| EVALUATION SAMPLE Z | 3 | 3 | 3 | 3 | 3 | 3 | 2 | 2 | 3 | 3 | 2.8 |

| CONDITION | GLOSS DIFFERENCE [%] |
|---|---|
| NO COOLING | 24.3 |
| COOLING | 12 |

GLOSS IMPARTING METHOD, IMAGE FORMING METHOD, FIXING APPARATUS AND IMAGE FORMING APPARATUS

CROSS-REFERENCE TO RELATED APPLICATIONS

This application is based on and claims priority under 35 USC 119 from Japanese Patent Application No. 2008-78754 filed Mar. 25, 2008.

BACKGROUND

1. Technical Field

The present invention relates to a gloss imparting method, an image forming method, a fixing apparatus and an image forming apparatus.

2. Related Art

In recent years, higher image quality high-gloss images have been demanded with the spread of full color copiers and printers.

SUMMARY

The present invention provides a gloss-imparting method that includes (a) applying heat and pressure to one side of a recording material having an image of toner formed on both sides, and fixing the image to the one side of the recording material, (b) cooling the one side of the recording material on which the image was fixed in the step (a), (c) applying heat and pressure to the other side of the recording material cooled in the step (b), and fixing the image to the other side of the recording material, and (d) cooling the other side of the recording material on which the image was fixed in the step (c). In the step (a), the fixing is performed such that a value of $\exp(-T \cdot \tan \delta_0)$ will be approximately 0.85 or less, where $\tan \delta_0$ is a loss tangent of the toner when measured by dynamic viscoelastic measurement at a frequency of approximately 1 rad/sec at approximately the same temperature as a fixing temperature of the step (a), and T is a fixing time in the step (a).

BRIEF DESCRIPTION OF THE DRAWINGS

Exemplary embodiment(s) of the present invention will be described in detail based on the following figures, wherein.

DETAILED DESCRIPTION

1. Configuration

The configuration of an image forming apparatus according to an exemplary embodiment will be described. This image forming apparatus is constituted by an image forming section that forms images and a secondary fixing section that imparts gloss to images formed by the image forming section. Here, the configuration of the image forming section will be described firstly, after which the configuration of the secondary fixing section will be described.

1-1. Configuration of Image Forming Section

Figure 1:
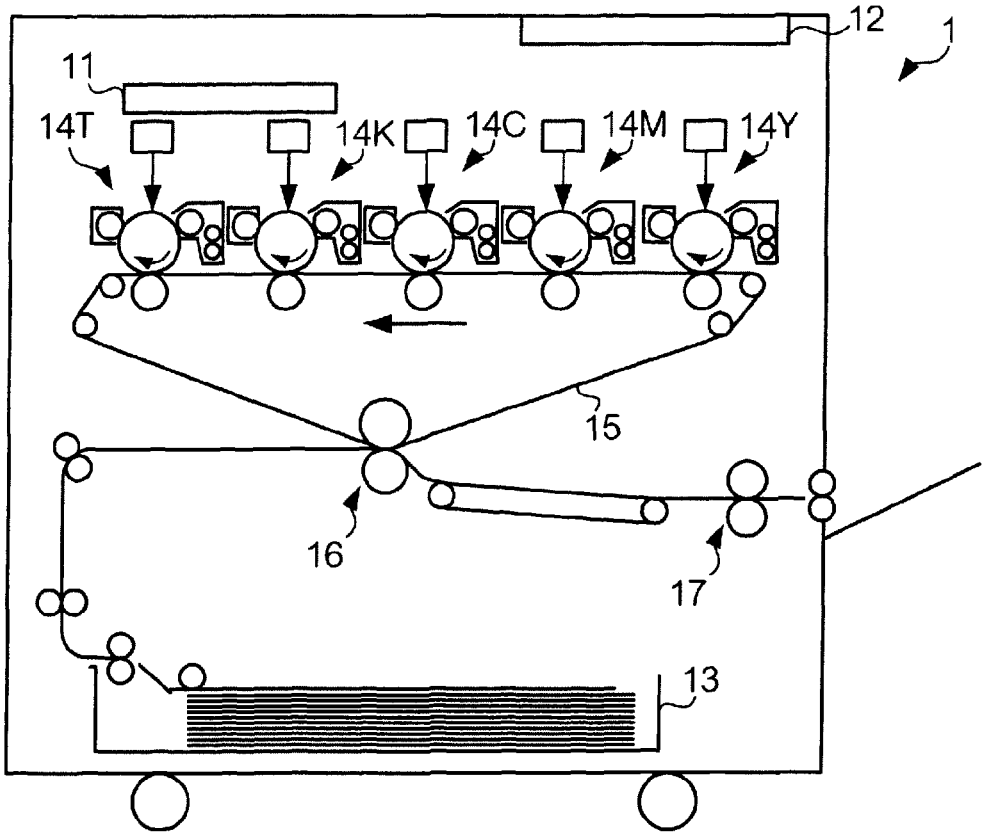
FIG. 1 schematically shows a configuration of an image forming section according to an exemplary embodiment.

FIG. 1 schematically shows the configuration of an image forming section 1 according to the exemplary embodiment. As shown in FIG. 1, the image forming section 1 is a device that performs image forming with a so-called tandem system. The image forming section 1 includes a controller 11, a display operating section 12, a paper feeding section 13, image forming units 14Y, 14M, 14C, 14K and 14T, an intermediate transfer belt 15, a secondary transfer section 16, and a primary fixing section 17. Note that in the following description, the image forming units 14Y, 14M, 14C, 14K and 14T will be collectively referred to as "image forming unit 14" if it is not necessary to distinguish between them.

The controller 11 performs various processes as well as controlling the various components of the image forming section 1. The controller 11 includes a central processing unit (CPU) that executes processes in accordance with programs, a read only memory (ROM) that stores programs used by the CPU, a random access memory (RAM) that is used as a work area of the CPU, a communication interface that communicates with external computer devices (not shown), an image processing circuit that performs image processing on image data input from a scanner device or an external computer device (not shown), and an input/output interface that inputs and outputs signals from and to the display operating section 12. The display operating section 12 includes a touch panel, and outputs operating signals according to operations by an operator, as well as performing image display instructed by the controller 11. The paper feeding section 13 houses sheets of paper cut to a prescribed size such as A3 or A4, and feeds out the sheets one at a time at a timing instructed by the controller 11. Sheets fed out from the paper feeding section 13 are transported to the secondary transfer section 16.

The image forming units 14Y, 14M, 14C, 14K and 14T form toner images respectively using yellow, magenta, cyan, black and transparent toner, and transfer these toner images in layers to the intermediate transfer belt 15. These image forming units 14 are arranged along the travel direction of the intermediate transfer belt 15. The image forming units 14 each include a photosensitive drum that carries an image, a charging section that uniformly charges the photosensitive drum to a predetermined potential, an exposure section that forms a latent image by irradiating the photosensitive drum with light according to the image data of the corresponding color, a developing section that forms a toner image by developing the latent image with toner of the corresponding color, and a primary transfer roller that transfers the toner image to the intermediate transfer belt 15 using the potential difference with the photosensitive drum.

The image forming units 14Y, 14M, 14C and 14K each form a toner image according to image data input from a scanner device or an external computer device (not shown). The image forming unit 14T forms a layer of transparent (colorless) toner on the toner images formed by the other image forming units, so as to cover the entire surface of the sheet on which these toner images are formed. The transparent color toner (hereinafter, "transparent toner"), being colorless, is transparent on the sheet.

Here, the composition of the transparent toner will be described in detail. This transparent toner is generated by mixing a crystalline polyester resin with one or more amorphous polyester resins. That is, the uppermost toner to be layered on the sheet is configured to include a crystalline linear aliphatic polyester resin and one or more amorphous resins. The inclusion of a crystalline polyester resin enables fixing to be favorably performed at a relatively low temperature, and further improves toner blocking resistance (toner storage stability) and image preservability. Since charge characteristics deteriorate when a crystalline polyester resin is included, this could cause image defects, although since the transparent toner is transparent on the sheet as mentioned above, image defects will not be readily noticeable should they occur.

The intermediate transfer belt 15 is caused to travel around by drive rollers (not shown). Once the toner images have been sequentially transferred in layers by the image forming units 14Y, 14M, 14C, 14K and 14T, the transferred toner images are transported to the secondary transfer section 16. The secondary transfer section 16 includes a secondary transfer roller and an opposing roller. The secondary transfer section 16 transfers the toner images on the intermediate transfer belt 15 to the sheet transported from the paper feeding section 13, using the potential difference with the intermediate transfer belt 15. The primary fixing section 17 includes a fixing roller and a pressure roller. The primary fixing section 17 applies heat and pressure to the sheet transported from the secondary transfer section 16 and fixes the toner images to the sheet.

The sheet fixed by the primary fixing section 17 is transported directly to a paper exit port by a paper transport section if the controller 11 instructs to form a single-sided image. If the controller 11 instructs to form a double-sided image, the sheet is again transported to the secondary transfer section 16 after being reversed back to front by a reversal transport section (not shown). This sheet is then transported to the paper exit port after the toner images have this time been transferred to the backside thereof by the secondary transfer section 16 and fixed by the primary fixing section 17. That is, the image forming section 1 acts as an image forming part that forms images of toner of various colors in layers on both sides of a sheet. The user sets the sheet exited the paper exit port of the image forming section 1 in the secondary fixing section when he or she wants to finish the image in high gloss.

1-2. Configuration of Secondary Fixing Section

Figure 2:
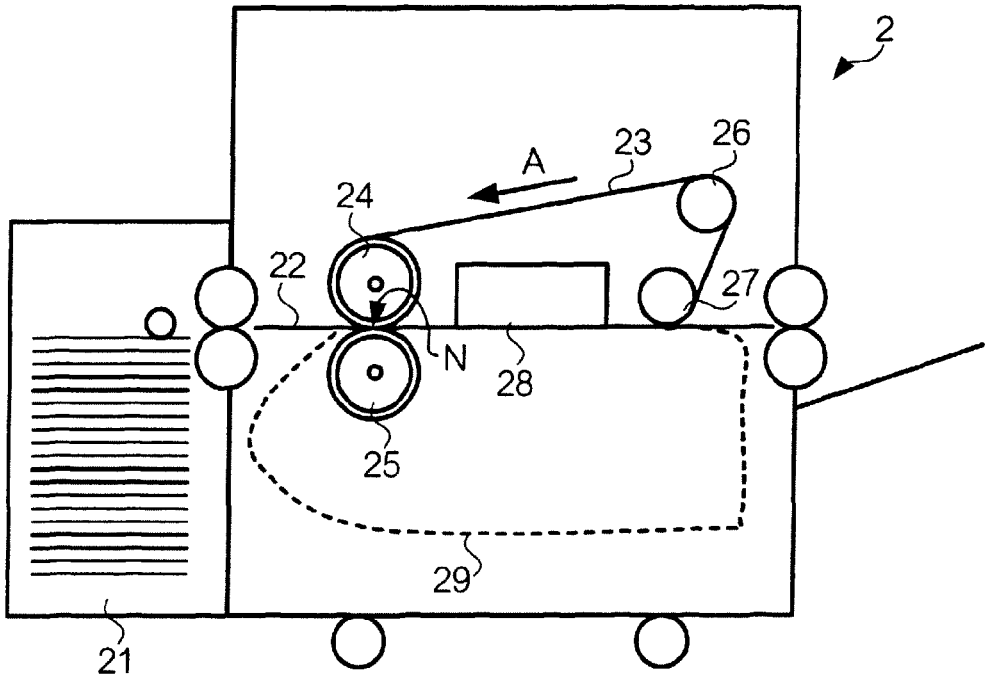
FIG. 2 schematically shows a configuration of a secondary fixing section according to the exemplary embodiment.

FIG. 2 schematically shows a configuration of a secondary fixing section 2 according to the exemplary embodiment. As shown in FIG. 2, the secondary fixing section 2 includes a paper feeding section 21, a paper transport section 22, a fixing belt 23, a fixing roller 24, a pressure roller 25, a steering roller 26, a separation roller 27, a cooling section 28, and a reversal transport section 29. The paper feeding section 21 houses sheets of paper set by the user, and feeds out the sheets one at a time. The paper transport section 22 transports sheets fed out from the paper feeding section 21 to a nip area N between the fixing roller 24 and the pressure roller 25. In the exemplary embodiment, the length of the nip area N in the paper transport direction (fixing nip width) is approximately 3.2 mm.

The fixing belt 23 is stretched over the fixing roller 24, the steering roller 26 and the separation roller 27, and travels around in the direction of arrow A in FIG. 2 with the rotation of the fixing roller 24. The fixing belt 23 includes a base material layer and a surface layer formed on the base material layer. Note that a bonding layer that bonds the base material layer and the surface layer may be included between these layers. This base material layer is formed with a metal sheet such as nickel, aluminum or stainless steel, or a resin film such as polybutylene terephthalate, polyimide or polyimide-amide, in order to enhance heat resistance and mechanical strength. If the base material layer is formed using a resin film, electrostatic absorption of dust due to charging may be suppressed by dispersing a conductive powder such as carbon black (carbon powder), or the like, throughout the base material layer to reduce volume resistivity. The thickness of the base material layer is in a range of 30 to 200 μm, preferably in a range of 40 to 150 μm, and more preferably in a range of 50 to 130 μm. This is because if the thickness of the base material layer is less than 30 μm, there will be a large dimensional change when cooled after heating, as well as there being a strength deficiency, whereas if the thickness of the base material layer exceeds 200 μm, the heat capacity of the fixing belt 23 will be increased, making it difficult to conduct heat. In the exemplary embodiment, the fixing belt 23 is constituted by a polyimide base material layer and a 30 μm surface layer having releasability that is coated with silicone rubber using a doctor blade. The fixing belt 23 has a circumferential length of 164 mmϕ, a width of 320 mm, and a thickness of 80 μm.

The fixing roller 24 is rotated by a drive section (not shown) with the center of the fixing roller as the axis. The fixing roller 24 applies heat to the sheet transported by the paper transport section 22. The fixing roller 24 is formed with a release layer composed of PFA tubing or the like around a highly heat-conductive metal core, and is provided with a halogen lamp inside the core. The surface of the fixing roller 24 is heated to approximately 120° C. to 190° C. using heat generated by the halogen lamp.

The pressure roller 25 is provided so as to face the fixing roller 24 with the fixing belt 23 sandwiched therebetween by pressure, and applies pressure to the sheet transported by the paper transport section 22 while rotating with the rotation of the fixing roller 24. The pressure roller 25 has an elastic body layer composed of fluororubber with a rubber hardness (JIS-A) of about 60° coated around a highly heat-conductive metal core, or the like, with a release layer similar to the fixing roller 24 formed on the surface thereof. Note that while the exemplary embodiment is described using an example in which a halogen lamp is not provided inside the core of the pressure roller 25, a halogen lamp may be provided inside the core.

The steering roller 26 rotates with the circular movement of the fixing belt 23, and corrects for bias that occurs when the fixing belt 23 travels around continuously (phenomenon whereby the fixing belt 23 moves in the rotation axis direction of the steering roller 26). Specifically, the steering roller 26 changes the angle relative to the travel direction of the fixing belt 23 by rocking according to the bias of the fixing belt 23 and suppressing movement of the fixing belt 23 in the axis direction of the steering roller 26.

The separation roller 27 rotates with the circular movement of the fixing belt 23, and is configured such that the sheet transported in close contact with the fixing belt 23 is separated at the installation position of the separation roller. The outer diameter of the separation roller 27 and the wrap angle of the fixing belt 23 are determined according to the adherence between the paper and the fixing belt 23 and the stiffness of the paper.

The cooling section 28 is a so-called heat sink that is provided so as to contact the inner peripheral surface of the fixing belt 23 between the fixing roller 24 and the separation roller 27. The cooling section 28, which includes a casing formed with a highly heat-conductive metal and a fin (plate-like protruding member) formed with a highly heat-conductive metal and provided inside the casing, absorbs heat from the fixing belt 23 and the sheet heated by the fixing roller 24, and reduces the temperature of the sheet to approximately 60 to 80° C. The heat absorbed by the casing is released into the air inside the cooling section 28 by the fin, before exiting the secondary fixing section 2 by a rotation fan (not shown). By cooling the sheet in this way, the toner images on the sheet solidify with the smoothness of the surface of the fixing belt 23 transferred thereto and it is made easier to separate the sheet from the fixing belt 23.

The reversal transport section 29 transports the sheet separated from the fixing belt 23 at the position of the separation roller 27 to the nip area N between the fixing roller 24 and the pressure roller 25 with the sheet having been reversed front to back. The sheet transported to the nip area N by the paper transport section 22 thereby firstly has the front side thereof fixed and cooled, before again being transported to the nip area N by the reversal transport section 29 and this time having the backside thereof fixed and cooled. That is, the fixing roller 24 and the pressure roller 25 act as a first fixing part that adds heat and pressure to one side of a sheet having a toner image formed on both sides to fix the toner image, and as a second fixing part that adds heat and pressure to the other side of the sheet cooled by the cooling section 28 to fix the toner image. Also, the cooling section 28 acts as a first cooling part that cools the one side of the sheet on which the toner image was fixed by the fixing roller 24 and the pressure roller 25, and as a second cooling part that cools the other side of the sheet on which the toner image was fixed by the fixing roller 24 and the pressure roller 25.

Note that in the following description, the transporting of a sheet to the nip area N by the paper transport section 22 and the fixing and cooling of the front side thereof will be called a "first side fixing step", while the reversing and transporting of a sheet that has undergone the first side fixing step to the nip area N and the fixing and cooling of the backside thereof will be called a "second side fixing step".

2. Operations

Next, the operations of the image forming section 1 and the secondary fixing section 2 will be described. When image data is input from a scanner device or an external computer device (not shown) and double-sided image forming is instructed, the image forming section 1 forms images according to the image data on the front and back sides of a sheet, and outputs the sheet from the paper exit port. At this time, a layer of transparent toner is formed on the front and back sides of the sheet so as to cover the entire surface thereof. Once a sheet having images formed on both sides has exited the image forming section 1, the user sets this sheet in the paper feeding section 21 of the secondary fixing section 2. The sheet set in the paper feeding section 21 is transported to the nip area N between the fixing roller 24 and the pressure roller 25 by the paper transport section 22, with the front side thereof facing the fixing roller 24.

Having been transported to the nip area N, this sheet has heat and pressure applied thereto by the fixing roller 24 and the pressure roller 25 while in close contact with the fixing belt 23. The toner images on the front side of the sheet thereby melt and adhere to the surface of the fixing belt 23. As described above, the sheet adhered to the surface of the fixing belt 23 is transported to the cooling section 28 and the separation roller 27 in this state, since the fixing belt 23 travels around in the direction of arrow A in FIG. 2. Having traveled to the position of the cooling section 28, the heat of the sheet being transported by the fixing belt 23 is absorbed by the cooling section 28. The toner images on the front of sheet thereby solidify with the smoothness of the surface of the fixing belt 23 transferred thereto. Subsequently, having traveled to the position of the separation roller 27, the sheet transported by the fixing belt 23 is separated from the fixing belt 23 by the stiffness of the sheet.

The sheet that has thus undergone the first side fixing step is reversed back to front by the reversal transport section 29, and again transported to the nip area N between the fixing roller 24 and the pressure roller 25, with the backside facing the fixing roller 24. This sheet then undergoes fixing and cooling similarly to the first side fixing step, this time on the backside. The sheet that has thus undergone the second side fixing step exits the paper exit port. The images on both sides of the sheet are thereby finished in high gloss.

If stress remaining in the toner on the front of the sheet is high after undergoing the above first side fixing step, the gloss of the image on the front of the sheet will be less than the gloss of the image on the back of the sheet once the sheet has passed through the second side fixing step. This is because when the back of the sheet is heated in the second side fixing step, the toner images on the front of the sheet that have solidified in a smooth state are again melted by the heat, creating unevenness in the toner images due to the stress remaining in the toner on the front of the sheet being released, and resulting in the toner images on the front of the sheet losing their smoothness.

Figures 3, 4, 5, 10:
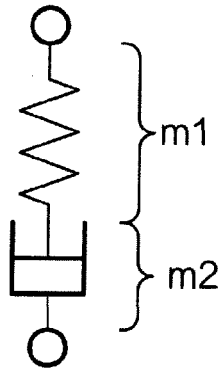
FIG. 3 shows a Maxwell model for a viscoelastic body.
FIG. 4 shows fixing times and toner types.
FIG. 5 illustrates image samples according to the exemplary embodiment.
FIG. 10 illustrates image samples according to a further modification.

The stress in the toner on the front of the sheet after the first side fixing step can be derived by the following calculation. FIG. 3 shows a Maxwell model for a viscoelastic body such as toner. In this Maxwell model, the total deformation $\gamma$ can be represented by the following expression (1), where $\gamma_1$ is the distortion of a spring component $m_1$, and $\gamma_2$ is the deformation of a dashpot component $m_2$.

Expression (1)

$$\gamma=\gamma_1+\gamma_2 \tag{1}$$

Stress $\sigma$ can be represented by the following expression (2), where G is the elastic modulus of the spring component $m_1$, and $\eta$ is the viscous modulus of the dashpot component $m_2$.

Expression (2)

$$\sigma=G\cdot\gamma_1=\eta\cdot d\gamma_2/dt \tag{2}$$

Solving the simultaneous equation of expression (2) and the above expression (1) gives the following expression (3). Here, the total deformation $\gamma$ is constant, and $\tau$ is the relaxation time.

Expression (3)

$$\sigma(t)=\sigma_0\cdot\exp(-t/\tau) \tag{3}$$

The relaxation time $\tau$ can be represented by the following expression (4), where $\omega_0$ is the angular frequency, and $\tan\delta_0$ is the loss tangent of the toner.

Expression (4)

$$\tau=\eta/G=1/(\omega_0\cdot\tan\delta_0) \tag{4}$$

Substituting expression (4) into expression (3) gives the following expression (5). Here, the time t for imparting deformation is a fixing time T of the fixing roller 24, and the angular frequency $\omega_0$ is 1 rad/sec.

Expression (5)

$$\sigma=\exp(-T\cdot\tan\delta_0) \quad (5)$$

As evident from expression (5), the stress σ of the toner on the front on the sheet after the first side fixing step can be represented by the relation between the first side fixing time T and the loss tangent tan $\delta_0$ of the toner. If the value of exp(−T·tan $\delta_0$) in expression (5) is large, the stress σ of the toner on the front on the sheet after the first side fixing step will be high, resulting in a large reduction in the gloss of the image on the front of the sheet. On the other hand, if the value of exp(−T·tan $\delta_0$) in expression (5) is small, the stress σ of the toner on the front on the sheet after the first side fixing step will be low, resulting in a small reduction in the gloss of the image on the front of the sheet.

The inventors, through testing, arrived at an exp(−T·tan $\delta_0$) value at which the gloss difference between the front and back of the sheet is lessened. Firstly, the content of this testing will be described. This testing involved investigating the gloss difference obtained by measuring the gloss level of the image on the front of the sheet and the gloss level of the image on the back of the sheet for four image samples A to D having different fixing times and loss tangents of the toner, and subtracting the gloss level of the image on the back of the sheet from the gloss level of the image on the front of the sheet. Gloss levels were measured using a BYK-Gardner micro-gloss gloss meter at a 20° angle of incidence.

All of the image samples A to D were formed by the image forming section 1 in which a secondary color patch image obtained by mixing yellow, magenta and cyan was formed on the front and back of the sheet, and a layer of transparent toner was layered on the secondary color patch images. Single-sided 256 gsm (grams per square meter) cast-coated paper was used for the image samples A to D, with the cast-coated surface being the front side. Additionally, all of the image samples A to D were cooled at a cooling temperature of 70° C. after being fixed at a fixing temperature of 120° C. and a fixing nip pressure of 0.86 MPa in the first side fixing step, and then fixed at a fixing temperature of 180° C. in the second side fixing step by the secondary fixing section 2. Note that other conditions such as the fixing nip pressure and the cooling temperature in the second side fixing step were similar to the first side fixing step.

Here, the fixing times and loss tangents of the toner for the image samples A to D will be described in detail. FIG. 4 shows the fixing times T and toner types of the image samples A to D. The fixing time T is the time taken for a sheet to pass through the nip area N in the first side fixing step. As shown in FIG. 4, toner p was used for the image sample A, with a fixing time of 0.08 sec. Toner p was also used for the image sample B, with fixing time of 0.3 sec. Toner q was used for the image sample C, with a fixing time of 0.08 sec, and toner q was also used for the image sample D, with a fixing time of 0.3 sec. Note that, in this testing, the length of the fixing time T was switched between 0.08 sec and 0.3 sec by controlling the transport speed of the sheet when passing through the nip area N.

While polyester obtained by a suspension polymerization method was a main component of both toners p and q, the rheological properties of the toners differed. Toner p had an elastic modulus G' in a range of $3\times10^3$ to $4\times10^3$ Pa and a loss tangent tan δ in a range of 0.8 to 1.2, when measured by dynamic viscoelastic measurement at a frequency of 1 rad/sec in a temperature range of 110° C. to 130° C. On the other hand, toner q had an elastic modulus G' in a range of $4\times10^2$ to $1\times10^3$ Pa and a loss tangent tan δ in a range of 2.5 to 3.0, when measured by dynamic viscoelastic measurement under the same conditions as above.

Substituting the fixing times T and loss tangents tan $\delta_0$ of the toner for the image samples A to D into the above expression (5) gives the exp(−T·tan $\delta_0$) values of the image samples A to D. With the examples shown in FIG. 4, the exp(−T·tan $\delta_0$) value of the image sample A is 0.92, the exp(−T·tan $\delta_0$) value of the image sample B is 0.74, the exp(−T·tan $\delta_0$) value of the image sample C is 0.79, and the exp(−T·tan $\delta_0$) value of the image sample D is 0.41.

Next, the test results will be described. FIG. 5 shows the exp(−T·tan $\delta_0$) values and gloss differences of the image samples A to D. As shown in FIG. 5, according to the test results, the image sample A with an exp(−T·tan $\delta_0$) value of 0.92 has a gloss difference between the images on the front and back of the sheet of 41%. The image sample B with an exp(−T·tan $\delta_0$) value of 0.74 has a gloss difference between the images on the front and back of the sheet of 22.6%. Further, the image sample C with an exp(−T·tan $\delta_0$) value of 0.79 has a gloss difference between the images on the front and back of the sheet of 24.3%, and the image sample D with an exp(−T·tan $\delta_0$) value of 0.41 has a gloss difference between the images on the front and back of the sheet of 6.8%.

Figures 6, 7, 9:
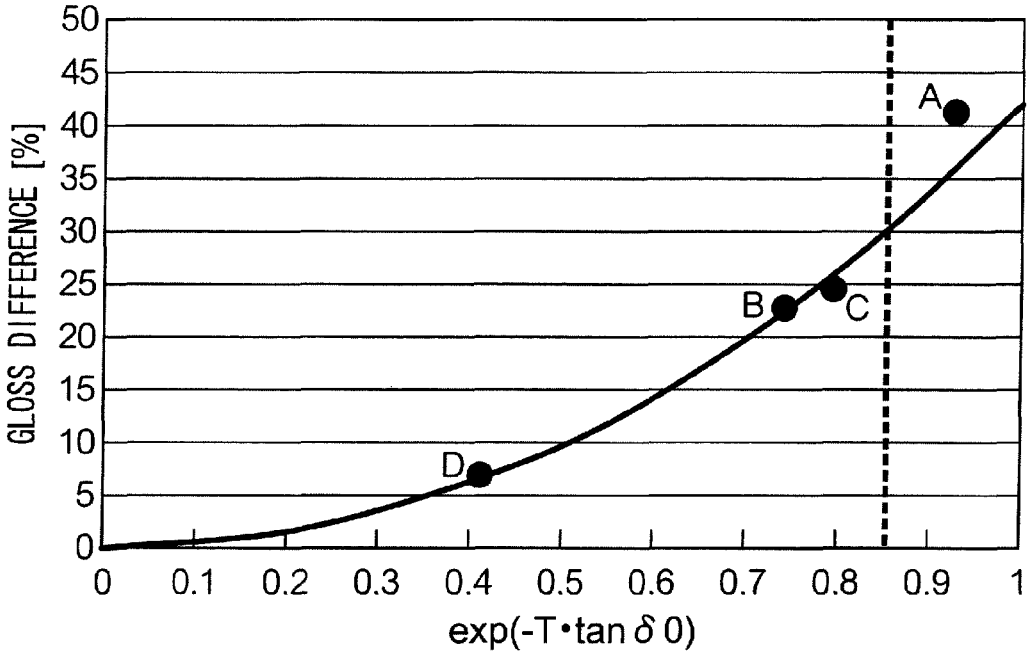
FIG. 6 shows test results according to the exemplary embodiment.
FIG. 7 shows evaluation results of comparing evaluation samples with a reference sample.
FIG. 9 shows gloss differences when cooling is performed and when cooling is not performed according to the modification.

FIG. 6 shows the correspondence relation between the exp(−T·tan $\delta_0$) values and gloss differences of the image samples A to D. The points A to D in FIG. 6 respectively represent the exp(−T·tan $\delta_0$) values and the gloss differences of the image samples A to D. According to FIG. 6, it is evident that to achieve a gloss difference of 30% or less, an exp(−T·tan $\delta_0$) value of 0.85 or less is required. That is, in order to lessen the gloss difference between the image on the front and the image on the back of the sheet, the fixing can be performed such that the value of exp(−T·tan $\delta_0$) is approximately 0.85 or less, where tan $\delta_0$ is the loss tangent of the toner when measured by dynamic viscoelastic measurement at a frequency of 1 red/sec or approximately 1 rad/sec at approximately the same temperature as the fixing temperature in the first side fixing step, and T is the fixing time in the first side fixing step.

Note that setting 30% or less as the benchmark at which the gloss difference is regarded as small is based on the following test results. FIG. 7 shows evaluation results obtained when ten subjects I to X compared an evaluation sample X having a gloss level of 75%, an evaluation sample Y having a gloss level of 60% and an evaluation sample Z having a gloss level of 50% with a reference sample having a gloss level of 90%. In FIG. 7, "1" represents an evaluation indicating that the gloss reduction in the evaluation sample was hardly visible, "2" represents an evaluation indicating that the gloss reduction in the evaluation sample was visible but acceptable, and "3" represents an evaluation indicating that the gloss reduction in the evaluation sample was visible and unacceptable.

According to the test results, the evaluation sample X having a 15% gloss difference with the reference sample was evaluated at "1" or "2" by all of the subjects I to X. The evaluation sample Y having a 30% gloss difference with the reference sample was evaluated at "3" by subject V, and "2" by the other subjects. On the other hand, the evaluation sample Z having a 40% gloss difference with the reference sample was evaluated at "2" by subjects VII and VIII, and "3" by the other eight subjects. In other words, nearly all of subjects evaluated the gloss reduction in the evaluation sample Z as being unacceptable. While the exp(−T·tan $\delta_0$) value needs to be reduced in order to lessen the amount of gloss reduction, the fixing time T has to be lengthened or the value of the loss tangent tan δ of the toner has to be increased to achieve this. Lengthening the fixing time T hinders device miniaturization, while increasing the value of the loss tangent tan $\delta_0$ of the toner makes offset more likely to occur during fixing. Consequently, in this exemplary embodiment, a gloss difference of up to 30% is established as an acceptable range for gloss reduction.

According to the exemplary embodiment described above, by setting the above exp(−T·tan $\delta_0$) value to approximately 0.85 or less, the gloss difference between the image on the front and the image on the back of the sheet can be reduced to 30% or less. That is, the gloss difference between the gloss of an image formed on one side of a recording material and the gloss of an image formed on the other side of the recording material can be lessened. In the case where sheets with images formed on both sides are bound as a booklet, for example, the backside of the previous sheet will be arranged as the left page and the front side of the next page will be arranged as the right page. In this case, the user will notice something strange if there is a large gloss difference between the right and left pages, since he or she views these pages together. According to the above exemplary embodiment, the user will feel little incongruity in such cases, because the gloss difference between the right and left pages will have been lessened.

3. Modifications

While an exemplary embodiment has been described above, this exemplary embodiment can be modified as follows. The following modifications may be appropriately combined.

3-1. Modification 1

Figure 8:
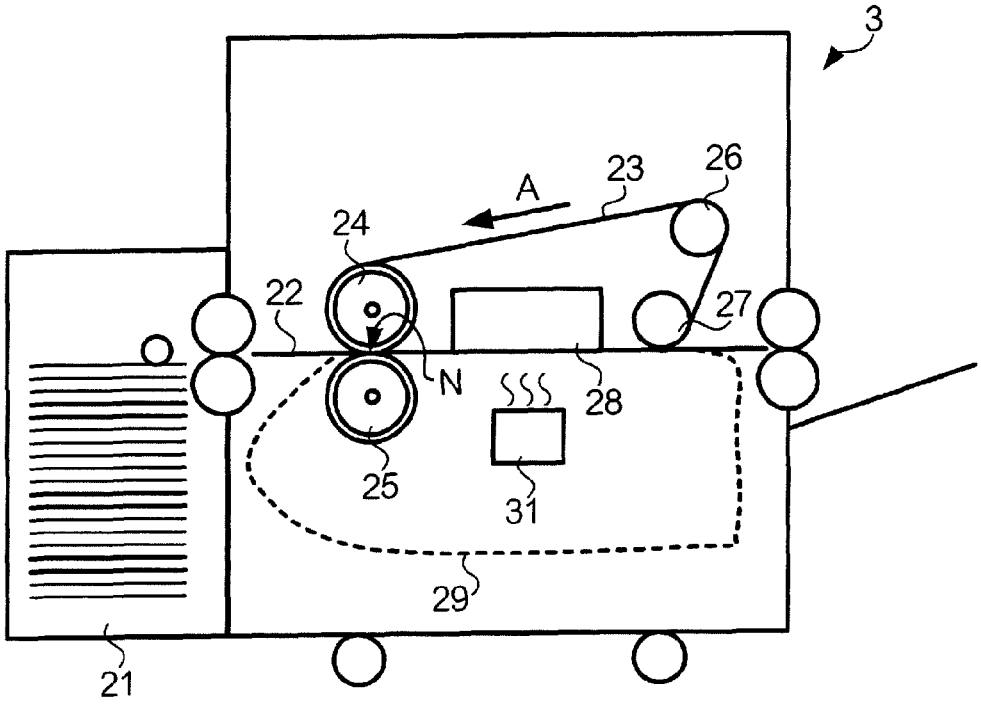
FIG. 8 schematically shows a configuration of a secondary fixing section according to a modification.

The above secondary fixing section 2 may be provided with an air blast cooling section that cools the front of the sheet by air blasting in the second side fixing step. FIG. 8 schematically shows the configuration of a secondary fixing section 3 according to this modification. As shown in FIG. 8, the secondary fixing section 3 is provided with an air blast cooling section 31. Note that the configuration of the secondary fixing section 3 apart from the air blast cooling section 31 is similar to the configuration of the secondary fixing section 2 shown in FIG. 2. The air blast cooling section 31 includes a rotating fan or the like, and cools the side of the sheet transported by the fixing belt 23 that is not in close contact with the fixing belt 23 by air blasting. In the second side fixing step, the front of the sheet will be cooled by the air blast cooling section 31, since the back of the sheet is in close contact with the fixing belt 23. That is, the air blast cooling section 31 acts as a third cooling part that cools the one side of the sheet while fixing by the fixing roller 24 and the pressure roller 25 and cooling by the cooling section 28 is being performed in the second fixing step.

FIG. 9 shows the gloss difference in the case where the image sample C shown in FIG. 4 was created without cooling by the air blast cooling section 31 and the gloss difference in the case where the image sample C was created with cooling by the air blast cooling section 31. The method of deriving the gloss difference is similar to the above exemplary embodiment. As shown in FIG. 9, in the case where cooling by the air blast cooling section 31 was not performed in the second side fixing step, the gloss difference between the image on the front and the image on the back of the sheet was 24.3%, similar to the test result shown in FIG. 5. On the other hand, in the case where cooling by the air blast cooling section 31 was performed in the second side fixing step, the gloss difference between the image on the front and the image on the back of the sheet was 12%. In other words, the gloss difference when cooling by the air blast cooling section 31 is performed can be suppressed to approximately half the gloss difference when cooling by the air blast cooling section 31 is not performed. Thus, if the front of the sheet is cooled by the air blast cooling section 31 in the second side fixing step, the gloss difference between the image on the front and the image on the back of the sheet can be further suppressed.

3-2. Modification 2

While the fixing times and loss tangents tan $\delta_0$ of the toner for the image samples were known in advance in the above exemplary embodiment, the inventors arrived, through testing, at a method for determining whether the above exp(−T·tan $\delta_0$) value is approximately 0.85 or less even with an image sample for which these values are not known. Here, this determination method will be described. Firstly, the gloss level of a given image sample in which a toner image having a gloss level of approximately 70% or greater measured at an approximately 20° angle of incidence is formed by an image forming apparatus having the above image forming section 1 and secondary fixing section 2 is measured at an approximately 20° angle of incidence, and the measured gloss level is set as a pre-heating gloss level. Next, one side of the image sample is heated for approximately 3 minutes in an approximately 85° C. oven, the gloss level of the image sample after heating is measured at an approximately 20° angle of incidence, and the measured gloss level is set as a post-heating gloss level. Next, the gloss difference between the pre-heating gloss level and the post-heating gloss level is computed, and it is determined whether the exp(−T·tan $\delta_0$) value is approximately 0.85 or less depending on whether the gloss difference is greater than a prescribed threshold. This is because if there is a large reduction in gloss level before and after heating, it can be said that stress σ remaining in the toner of the pre-heating image sample is high, whereas if there is a small reduction in gloss level before and after heating, it can be said that stress σ remaining in the toner of the pre-heating image sample is low, since the gloss level of the image sample after heating in the oven decreases according to the same principle by which the gloss level of the front of the sheet decreases in the above second side fixing step.

Figure 11:
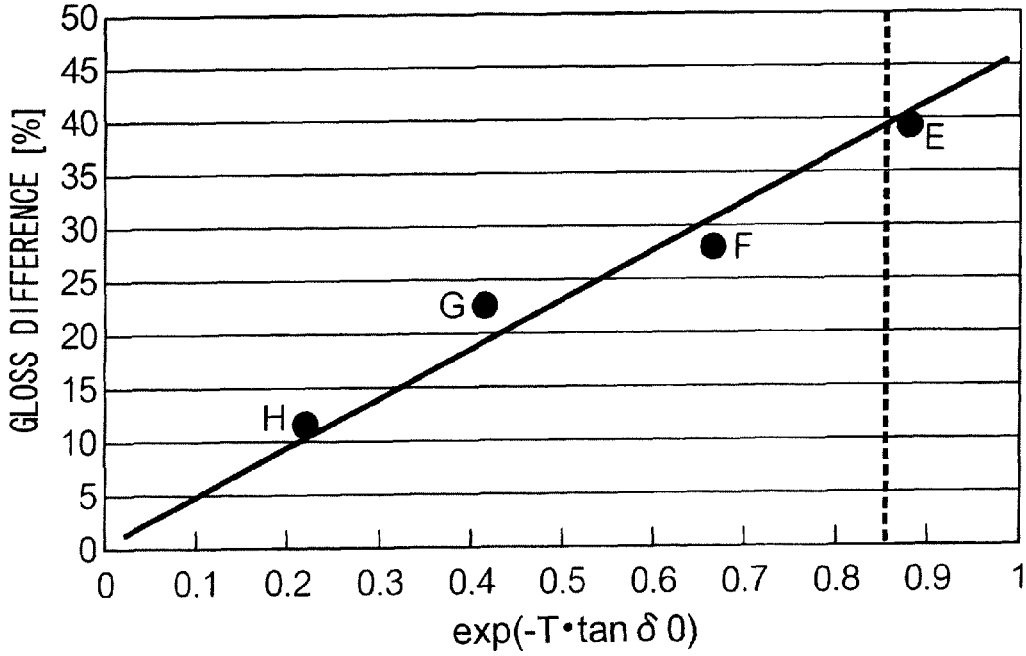
FIG. 11 shows test results according to the further modification.

Next, the test results of investigating the gloss differences before and after heating in an oven with the above procedure for four image samples E to H having different fixing times and loss tangents of the toner will be described. In the testing, a Yamato Scientific oven DK400T was used as the oven for heating the image samples. FIG. 10 shows the exp(−T·tan $\delta_0$) values of the image samples E to H and the gloss differences before and after heating with the oven. FIG. 11 shows the correspondence relation between the exp(−T·tan $\delta_0$) values of the image samples E to H and the gloss differences before and after heating with the oven. The points E to H in FIG. 11 respectively represent the exp(−T·tan $\delta_0$) values and the gloss differences of the image samples E to H. According to FIG. 11, it is evident that if the exp(−T·tan $\delta_0$) value is approximately 0.85 or less, the gloss difference will be approximately 40% or less. That is, it can be determined that if the gloss difference before and after heating is approximately 40% or less when the image sample is heated for 3 minutes or approximately 3 minutes in an 85° C. or approximately 85° C. oven, the exp(−T·tan $\delta_0$) value will be approximately 0.85 or less, where tan $\delta_0$ is the loss tangent of the toner when measured by dynamic viscoelastic measurement at a frequency of 1 red/sec or approximately 1 rad/sec at approximately the same temperature as the fixing temperature in the first side fixing step, and T is the fixing time in the first side fixing step.

3-3. Modification 3

While the above exemplary embodiment was described using an example of a configuration in which the image forming section 1 and the secondary fixing section 2 are provided separately, the image forming section 1 and the secondary fixing section 2 may be provided within the same casing. Processing in the image forming section 1 and processing in the secondary fixing section 2 is thereby performed continuously without the user setting sheets exited the image forming section 1 in the secondary fixing section 2. Also, the secondary fixing section 2 may be used as a sole fixing apparatus.

3-4. Modification 4

In the above exemplary embodiment, the reversal transport section 29 is provided in the secondary fixing section 2, and sheets that have undergone the first side fixing step are again transported to the nip area N by the reversal transport section 29, although the method of performing the first side fixing step and the second side fixing step is not limited to this. For example, the secondary fixing section 2 shown in FIG. 2 may be arranged in tandem with an inverse secondary fixing section constituted by inverting the secondary fixing section 2 top to bottom, and after the first side fixing step has been performed by the secondary fixing section 2, the second side fixing step may be performed by the inverse secondary fixing section. In this case, the fixing roller 24 and the pressure roller 25 of the secondary fixing section 2 act as a first fixing part, and the cooling section 28 of the secondary fixing section 2 acts as a first cooling part, while the fixing roller and the pressure roller of the inverse secondary fixing section act as a second fixing part, and the cooling section of the inverse secondary fixing section acts as a second cooling part.

3-5. Modification 5

The above exemplary embodiment was described using a method of controlling the transport speed of a sheet when passing through the nip area N between the fixing roller 24 and the pressure roller 25 as a method of changing the length of the fixing time T, although the present invention is not limited to this. For example, two fixing rollers 24 may be provided, one with a large roller diameter and one with a small roller diameter, and the length of the fixing time T may be changed by selectively using these rollers. Note that in the case where the length of the fixing time T is changed by controlling the transport speed of sheets when passing through the nip area N, as in the above exemplary embodiment, device miniaturization can be achieved in comparison to the case where two fixing rollers are used selectively.

3-6. Modification 6

The above transparent toner desirably has a storage elastic modulus G' of approximately $2\times10^3$ Pa or less and a loss tangent $\tan\delta_0$ of approximately 2 or more, when measured by dynamic viscoelastic measurement at a frequency of 1 rad/sec at approximately the same temperature as the fixing temperature in the first side fixing step. In this case, device miniaturization can be achieved in comparison to lengthening the fixing time T, since the fixing time T for reducing the $\exp(-T\cdot\tan\delta_0)$ value to approximately 0.85 or less can be set relatively short. Also, fixing properties can be improved by setting the storage elastic modulus G' to approximately $2\times10^3$ Pa or less. Further, the yellow toner, the magenta toner and the cyan toner may also have a storage elastic modulus G' of approximately $2\times10^3$ Pa or less and a loss tangent $\tan\delta_0$ of approximately 2 or more, when measured by dynamic viscoelastic measurement at a frequency of 1 red/sec or approximately 1 rad/sec at approximately the same temperature as the fixing temperature in the first side fixing step. That is, it is sufficient if at least the uppermost toner layered on the sheet has a storage elastic modulus of approximately $2\times10^3$ Pa or less and a loss tangent $\tan\delta_0$ of approximately 2 or more, when measured by dynamic viscoelastic measurement at a frequency of 1 rad/sec or approximately 1 rad/sec at approximately the same temperature as the fixing temperature of the first side fixing step.

3-7. Modification 7

In the above exemplary embodiment, only the transparent toner is generated by mixing a crystalline polyester resin with an amorphous polyester resin, although the present invention is not limited to this. The yellow toner, the magenta toner and the cyan toner may also be generated by mixing a crystalline polyester resin with an amorphous polyester resin. That is, it is sufficient if at least the uppermost toner to be layered on a sheet is configured to include a crystalline linear aliphatic polyester resin and one or more amorphous resins.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A gloss-imparting method comprising:

(a) applying heat and pressure to one side of a recording material having an image of toner formed on both sides, and fixing the image to the one side of the recording material;

(b) cooling the one side of the recording material on which the image was fixed in the step (a);

(c) applying heat and pressure to the other side of the recording material cooled in the step (b), and fixing the image to the other side of the recording material; and (d) cooling the other side of the recording material on which the image was fixed in the step (c), in the step (a), the fixing being performed such that a value of $\exp(-T\cdot\tan\delta_0)$ will be approximately 0.85 or less, where $\tan\delta_0$ is a loss tangent of the toner when measured by dynamic viscoelastic measurement at a frequency of approximately 1 rad/sec at approximately the same temperature as a fixing temperature of the step (a), and T is a fixing time in the step (a).

2. An image forming method comprising:

(a) forming an image of toner on both sides of a recording material;

(b) applying heat and pressure to one side of the recording material having the image formed on both sides, and fixing the image to the one side of the recording material;

(c) cooling the one side of the recording material on which the image was fixed in the step (b);

(d) applying heat and pressure to the other side of the recording material cooled in the step (c), and fixing the image to the other side of the recording material; and (e) cooling the other side of the recording material on which the image was fixed in the step (d), in the step (b), the fixing being performed such that a value of $\exp(-T\cdot\tan\delta_0)$ will be approximately 0.85 or less, where $\tan\delta_0$ is a loss tangent of the toner when measured by dynamic viscoelastic measurement at a frequency of approximately 1 rad/sec at approximately the same temperature as a fixing temperature of the step (b), and T is a fixing time in the step (b).

3. A fixing apparatus comprising:

a first fixing part that applies heat and pressure to one side of a recording material having an image of toner formed on both sides, and fixes the image to the one side of the recording material;

a first cooling part that cools the one side of the recording material on which the image was fixed by the first fixing part;

a second fixing part that applies heat and pressure to the other side of the recording material cooled by the first cooling part, and fixes the image to the other side of the recording material; and a second cooling part that cools the other side of the recording material on which the image was fixed by the second fixing part, a value of $\exp(-T \cdot \tan \delta_0)$ being approximately 0.85 or less, where $\tan \delta_0$ is a loss tangent of the toner when measured by dynamic viscoelastic measurement at a frequency of approximately 1 rad/sec at approximately the same temperature as a fixing temperature of the first fixing part, and T is a fixing time of the first fixing part.

4. The fixing apparatus according to claim 3, further comprising a third cooling part that cools the one side of the recording material during a period from the fixing by the second fixing part to the cooling by the second cooling part.

5. An image forming apparatus comprising:

an image forming part that forms an image of toner on both sides of a recording material;

a first fixing part that applies heat and pressure to one side of the recording material having the image formed on both sides by the image forming part, and fixes the image to the one side of the recording material;

a first cooling part that cools the one side of the recording material on which the image was fixed by the first fixing part;

a second fixing part that applies heat and pressure to the other side of the recording material cooled by the first cooling part, and fixes the image to the other side of the recording material; and a second cooling part that cools the other side of the recording material on which the image was fixed by the second fixing part, a value of $\exp(-T \cdot \tan \delta_0)$ being approximately 0.85 or less, where $\tan \delta_0$ is a loss tangent of the toner when measured by dynamic viscoelastic measurement at a frequency of approximately 1 rad/sec at approximately the same temperature as a fixing temperature of the first fixing part, and T is a fixing time of the first fixing part.

6. The image forming apparatus according to claim 5, wherein the image forming part forms images of toner of a plurality of colors in layers on the recording material, and at least the uppermost toner layered on the recording material has a storage elastic modulus of approximately $2 \times 10^3$ Pa or less and a loss tangent $\tan \delta_0$ of approximately 2 or more, when measured by dynamic viscoelastic measurement at a frequency of approximately 1 rad/sec at approximately the same temperature as a fixing temperature of the first fixing part.

7. The image forming apparatus according to claim 5, wherein at least the uppermost toner layered on the recording material is configured to include a crystalline linear aliphatic polyester resin and one or more amorphous resins.

8. The image forming apparatus according to claim 5, wherein the image forming part forms a layer of colorless toner so as to cover an entire surface of the recording material and the image of toner formed thereon.

* * * * *